United States Patent [19]

Mackey et al.

[11] 4,070,212

[45] Jan. 24, 1978

[54] HIGH PERFORMANCE FAST BURNING SOLID PROPELLANT

[75] Inventors: Johnny R. Mackey; Earl T. Foster, both of Huntsville, Ala.

[73] Assignee: Thiokol Corporation, Newtown, Pa.

[21] Appl. No.: 414,940

[22] Filed: Nov. 23, 1964

[51] Int. Cl.[2] ..... C06B 45/10

[52] U.S. Cl. ..... 149/19.2; 149/19.9; 149/19.93; 149/20; 149/112

[58] Field of Search ..... 149/112, 113, 21, 19, 149/19.2, 19.9, 20, 19.93; 260/439

[56] References Cited

U.S. PATENT DOCUMENTS

| | | | |
|---|---|---|---|
| 2,990,263 | 6/1961 | Avery | 149/19.91 |
| 3,022,149 | 2/1962 | Cramer | 149/19.1 |
| 3,022,206 | 2/1962 | Hutchinson et al. | 149/112 X |
| 3,044,910 | 7/1962 | Guth et al. | 149/19.9 |
| 3,087,844 | 4/1963 | Hudson et al. | 149/19.9 |
| 3,109,761 | 11/1963 | Cobb et al. | 149/19.4 |
| 3,255,281 | 6/1966 | Alexander | 264/3 R |
| 3,386,869 | 6/1968 | Green et al. | 149/19.2 |
| 3,447,981 | 6/1969 | Sayles | 149/19.2 |

OTHER PUBLICATIONS

DeYoung, Chem. Abs., 55, Abs. #21081d (1961).

*Primary Examiner*—Edward A. Miller
*Attorney, Agent, or Firm*—Stanley A. Marcus; William R. Wright, Jr.

EXEMPLARY CLAIM

1. A solid composite propellant consisting of 7% to 15% of a carboxyl-terminated butadiene polymer binder, 66% to 82% of ammonium perchlorate, greater than 0% to 18% of aluminum and greater than 0% to 8% of n-butyl ferrocene as a burning rate catalyst, the ingredient amounts being in weight per cent, and wherein the particle size of the ammonium perchlorate is greater than 0 but less than 3 microns in size.

4 Claims, No Drawings

HIGH PERFORMANCE FAST BURNING SOLID PROPELLANT

This invention relates to improvements in high burning rate composite solid propellants and, more particularly, to the use of an oxidizer wherein the particle size thereof is reduced far below the particle size of any oxidizer that is employed in present-day technique.

It has become imperative, at the present time, to produce composite solid propellants that have high burning rates with accompanying high performance far in excess of those that are in use at the present time.

It is a well-known fact that composite solid propellants have previously been limited in applications involving high performance fast burning propellants due to the insufficient range of burning rates available. High performance propellants require high oxidizer loadings that are intimately dispersed in the binder that is used as the basis for the composite solid propellant. If the particle size of the oxidizer to be used is of conventional size, then the homogeneous blend that results will not possess the same burning rate that would be achieved if the particle size of the oxidizer was greatly reduced.

This invention, therefore, has for one of its objects the accomplishment of a fast burning high performance propellant by the reduction of the average particle size of the oxidizer.

Heretofore, reduction of the particle size of the oxidizer was accomplished mainly by conventional grinding procedures, but more recently, the use of roll mills and dispersion mills has been initiated. These mills have been utilized to produce a polymer-oxidizer mixture which aided in processing the composite solid propellant. Even though roll mills and dispersion mills are commonly used for intimate dispersion of solids in liquid or semi-liquid media, none had been previously utilized to produce a polymeroxidizer mixture wherein the particle size of the oxidizer was of a minute size sufficient to produce a fast burning high performance composite solid propellant.

There have been many methods used for the production of fast burning high performance composite solid propellants, such as the addition of various curing agents, various types of binders and utilizing particles of 10 microns or larger in the composite solid propellant.

While the process of milling has been applied to the polymer and oxidizer used in composite solid propellant mixtures for various uses, none have previously produced a mixture wherein the particle size of the oxidizer has been 3 microns or less, which size is approximately one-third the size of the oxidizer particles that are incorporated into the composite solid propellant under present-day procedures.

The unique feature of the instant invention, therefore, is the application of a milling process which produces very small and homogeneously dispersed oxidizer particles that, when used in a composite solid propellant mix, greatly enhance the burning rate and high performance of the composite solid propellant.

Another object of the invention is to produce a high concentration of oxidizer in a composite solid propellant that results from the marked reduction of the particle size of the oxidizer.

In the production of composite solid propellants, it is necessary to achieve intimate admixtures of the ingredients thereof, and the use of the small particles of oxidizer that are contemplated by the instant invention more readily provides such a mixture.

After the complete blending of the composite solid propellant has been achieved, it is usually cast directly into a rocket motor case, and the composite solid propellant, thus produced, possesses all the desirable physical characteristics, such as high tensile strength coupled with a high modulus of elasticity.

Composite solid propellants, as presently known, comprise a binder, an oxidizer, a fuel and, in some instances, a burning rate catalyst. There are many binders in use at the present time but the instant invention utilizes a THIOKOL HC binder which is a liquid, imine-cured carboxyl-terminated butadiene polymer having an average molecular weight of 3,000 to 10,000. There are also many oxidizers that are in use but the instant invention utilizes ammonium perchlorate as the one that most greatly enhances the combustion characteristics of the composite solid propellant embodied in the instant invention. The burning rate catalyst used is THIOKOL Plastiscat IV, which is a liquid ferrocene derivative, e.g., an organo iron liquid produced from a reaction between n-butyl carbitol and solid ferrocene and known as n-butyl ferrocene.

The burning rate characteristics of the composite solid propellant embodying the instant invention may be varied according to the following formulations:

About 7% to 15% of THIOKOL HC binder, 66% to 82% of ammonium perchlorate, 0% to 18% of aluminum and 0% to 8% of THIOKOL PLastiscat IV. The ingredients are listed as parts by weight, and any variation of these ingredients, as noted, produces a composite solid propellant that has a burning rate much higher than is now available in conventional composite solid propellants.

The HC binder and ammonium perchlorate are produced as a milled paste, and the proportion of these ingredients, as blended, are in a ratio of 24/76 with the ammonium perchlorate being the larger ratio of the two.

The binder and the ammonium perchlorate are mixed and passed through a standard 3-roll dispersion mill where the reduction of the ammonium perchlorate particle size to less than 3 microns is accomplished by the adjustment of the mill rolls.

After the milling process is complete, the paste, thus produced, is ready to be used to complete the composite solid propellant mix.

The following is an example of the conventional procedure for producing a composite solid propellant mix:

1. Add binder and other liquid constituents, such as the THIOKOL Plastiscat IV to mixer and blend.
2. Add solid fuel (aluminum) and blend.
3. Add oxidizer and complete mixing.

as compared to the procedure contemplated by the instant invention wherein:

1. Add liquid ingredients, THIOKOL Plastiscat IV and the required amount of milled binder and oxidizer to incorporate the proper oxidizer level and blend.
2. Add solid fuel (aluminum) and blend.
3. Add additional amount of oxidizer to meet burning rate requirements and complete mixing.

After mixing, the mixture is cast into a rocket motor case and cured to required specifications.

Variations and modifications of the instant invention, as previously described, may be adhered to providing such variations and modifications fall within the spirit of the invention and the scope of the appended claims.

Having thus described the invention, what is claimed as new and desired to be secured by letters patent is:

1. A solid composite propellant consisting of 7% to 15% of a carboxyl-terminated butadiene polymer binder, 66% to 82% of ammonium perchlorate, greater than 0% to 18% of aluminum and greater than 0% to 8% of n-butyl ferrocene as a burning rate catalyst, the ingredient amounts being in weight percent, and wherein the particle size of the ammonium perchlorate is greater than 0 but less than 3 microns in size.

2. In a method for increasing the burning rate of a composite solid propellant comprising the mixture of a carboxy-terminated butadiene polymer binder, a fuel, n-butyl ferrocene as a burning rate catalyst and an oxidizer, the improvement comprising using an oxidizer that has been ground to a particle size greater than 0 but less than 3 microns.

3. A method, as in claim 2, wherein the particle size is varied to obtain the burning rate desired.

4. A method for producing a high burning rate composite solid propellant, consisting of milling a mixture of carboxyl-terminated butadiene polymer and ammonium perchlorate through a 3-roll dispersion mill until the ammonium perchlorate in the mixture has achieved a particle size greater than 0 but less than 3 microns, adding aluminum and n-butyl ferrocene as a liquid burning rate catalyst, blending the mixture to yield a homogeneous propellant, and then curing said propellant.

* * * * *